US009739112B2

(12) United States Patent
O'Dwyer et al.

(10) Patent No.: US 9,739,112 B2
(45) Date of Patent: Aug. 22, 2017

(54) DOWNHOLE PACKER

(71) Applicant: TIER 1 ENERGY SOLUTIONS INC., Edmonton (CA)

(72) Inventors: Kevin O'Dwyer, Fort Saskatchewan (CA); Jeffrey Golinowski, Sherwood Park (CA); Nathan Kathol, Chestermere (CA)

(73) Assignee: TIER 1 ENERGY SOLUTIONS INC., Edmonton, Alberta (CA)

( * ) Notice: Subject to any disclaimer, the term of this patent is extended or adjusted under 35 U.S.C. 154(b) by 16 days.

(21) Appl. No.: 14/922,528

(22) Filed: Oct. 26, 2015

(65) Prior Publication Data

US 2016/0115762 A1 Apr. 28, 2016

Related U.S. Application Data

(60) Provisional application No. 62/068,818, filed on Oct. 27, 2014.

(51) Int. Cl.
*E21B 33/129* (2006.01)
*E21B 23/06* (2006.01)
*E21B 33/12* (2006.01)

(52) U.S. Cl.
CPC ..... *E21B 33/12* (2013.01)

(58) Field of Classification Search
CPC ..... E21B 23/06; E21B 33/12; E21B 33/1208; E21B 33/1292
See application file for complete search history.

(56) References Cited

U.S. PATENT DOCUMENTS

| | | | | |
|---|---|---|---|---|
| 1,827,842 | A * | 10/1931 | Getty | E21B 33/12 166/143 |
| 4,438,811 | A * | 3/1984 | Patel | E21B 23/06 166/123 |
| 7,870,895 | B2 * | 1/2011 | Lucas | E21B 33/12 166/387 |
| 2015/0027704 | A1 * | 1/2015 | Andersen | E21B 33/12 166/285 |
| 2016/0177660 | A1 * | 6/2016 | Cuffe | E21B 33/12 166/387 |
| 2016/0258244 | A1 * | 9/2016 | Connelly | E21B 33/128 |

* cited by examiner

*Primary Examiner* — James G Sayre
(74) *Attorney, Agent, or Firm* — MH2 Technology Law Group, LLP

(57) ABSTRACT

A downhole packer includes a first locking member positioned at least partially around an outer surface of an oilfield tubular. The first locking member includes an inner surface that engages the outer surface of the oilfield tubular, and a tapered outer surface. A drive ring is positioned at least partially around the first locking member. The drive ring includes a reverse-tapered inner surface that engages the tapered outer surface of the first locking member. A first cap is movably coupled with the drive ring, disposed at least partially around the first locking member, and axially engaging the first locking member. Moving at least one of the first cap and the drive ring toward the other causes the drive ring to apply a radially-inward force on the first locking member, causing the first locking member to be secured to the tubular.

17 Claims, 3 Drawing Sheets

DOWNHOLE PACKER

CROSS-REFERENCE TO RELATED APPLICATIONS

This application claims priority to U.S. Provisional Patent Application having Ser. No. 62/068,818, which was filed on Oct. 27, 2014. The entirety of this provisional application is incorporated herein by reference.

BACKGROUND

A downhole packer may be run into a wellbore in a "collapsed" state. Once in a desired position in the wellbore, the packer may be actuated radially-outward into an "expanded" state. In the expanded state, the packer may seal an annulus in the wellbore between a tubular and the wellbore wall or between an inner tubular and an outer tubular. This may separate the annulus into a proximal portion and a distal portion and prevent fluid flow therebetween.

Generally, packers include a mandrel having a sealing element positioned on the outer surface thereof. The sealing element is configured to actuate from the collapsed state to the expanded state. The mandrel may be connected with upper and lower tubular members by a threaded, pin-and-box, connection such that the tubular members and the packer form a "string." This assembly may be suitable in cases where standard size threads are employed. However, specialty or otherwise non-standard threads are sometimes employed for the tubular members. As such, the threads on the mandrel of the packer may not be sized to engage the corresponding threads on the upper and/or lower tubular members. In such instances, a separate packer, with the correct size threads, or an adapter sub, is needed. What is needed is a packer that is configured to engage the tubular members in the string, e.g., notwithstanding the use of non-standard thread sizes in the tubulars.

SUMMARY

Embodiments of the disclosure may provide an apparatus for securing to an oilfield tubular. The apparatus may include a first cap configured to be positioned at least partially around an outer surface of a tubular, and a first drive ring configured to be positioned at least partially around the outer surface of the tubular and movably coupled with the first cap. The apparatus may also include a first locking member configured to be disposed axially between the first cap and the first drive ring and at least partially radially between the tubular and the first drive ring. The first cap, the first drive ring, and the first locking member may be configured such that moving at least one of the first cap and the first drive ring axially toward the other causes the first drive ring to apply a radially-inward force on the first locking member such that the first locking member is positionally fixed to the tubular.

Embodiments of the disclosure may further provide a downhole packer. The downhole packer may include a first locking member positioned at least partially around an outer surface of an oilfield tubular, the first locking member comprising an inner surface that engages the outer surface of the oilfield tubular, and a tapered outer surface, and a drive ring positioned at least partially around the first locking member and comprising a reverse-tapered inner surface that engages the tapered outer surface of the first locking member. The downhole packer may further include a first cap movably coupled with the drive ring, disposed at least partially around the first locking member, and axially engaging the first locking member. Moving at least one of the first cap and the drive ring toward the other causes the drive ring to apply a radially-inward force on the first locking member, causing the first locking member to be secured to the tubular. The downhole packer may also include a sealing element configured to be disposed at least partially around the tubular and held in position at least axially with respect thereto by the first locking member engaging the tubular. The sealing element is configured to expand radially-outward in response to application of an axially-directed, compressive force.

Embodiments of the disclosure may also provide a method for assembling a downhole packer. The method may include positioning a first cap, a first locking member, a drive ring, and a sealing element around an outer surface of a tubular. The first locking member may be positioned at least partially axially-between the first cap and the drive ring, and the first locking member may be positioned at least partially radially-between the outer surface of the tubular and the drive ring, at least partially radially-between the outer surface of the tubular and the first cap, or both. The first cap and the drive ring may be moved toward one another, thereby causing the first locking member to apply a radially-inward force against the outer surface of the tubular to secure the packer in place on the tubular.

Embodiments of the disclosure may further provide a method for actuating a packer in a wellbore. The method may include running the packer into the wellbore. The packer may include a first locking member positioned at least partially around an outer surface of a tubular. An inner surface of the first locking member may have a plurality of teeth formed thereon that contact the outer surface of the tubular, and an outer surface of the first locking member may be sloped at a non-zero angle with respect to the outer surface of the tubular. A drive ring may be positioned at least partially around the outer surface of the tubular. An inner surface of the drive ring may be sloped at a non-zero angle with respect to the outer surface of the tubular, and the inner surface of the drive ring may be configured to contact the outer surface of the first locking member. A first cap may be positioned at least partially around the outer surface of the tubular. An inner surface of the first cap may have a plurality of threads formed thereon that are configured to engage a plurality of threads formed on an outer surface of the drive ring. A sealing element may be positioned at least partially around the outer surface of the tubular and adjacent to the drive ring. A piston may be positioned at least partially around the outer surface of the tubular and adjacent to the sealing element. A sleeve may be positioned a least partially around an outer surface of the piston. A chamber may be defined between the outer surface of the tubular and the piston, between the outer surface of the tubular and the sleeve, or a combination thereof, and the chamber may be in fluid communication with an interior of the tubular through an opening in the tubular. A pressure of a fluid in the tubular and in the chamber may be caused to increase. In response to the increased pressure, the piston may move axially toward the sealing element, causing the sealing element to actuate radially-outward from a collapsed state to an expanded state.

BRIEF DESCRIPTION OF THE DRAWINGS

The invention may best be understood by referring to the following description and accompanying drawings that are used to illustrate embodiments of the invention. In the drawings.

DETAILED DESCRIPTION

Figure 1:
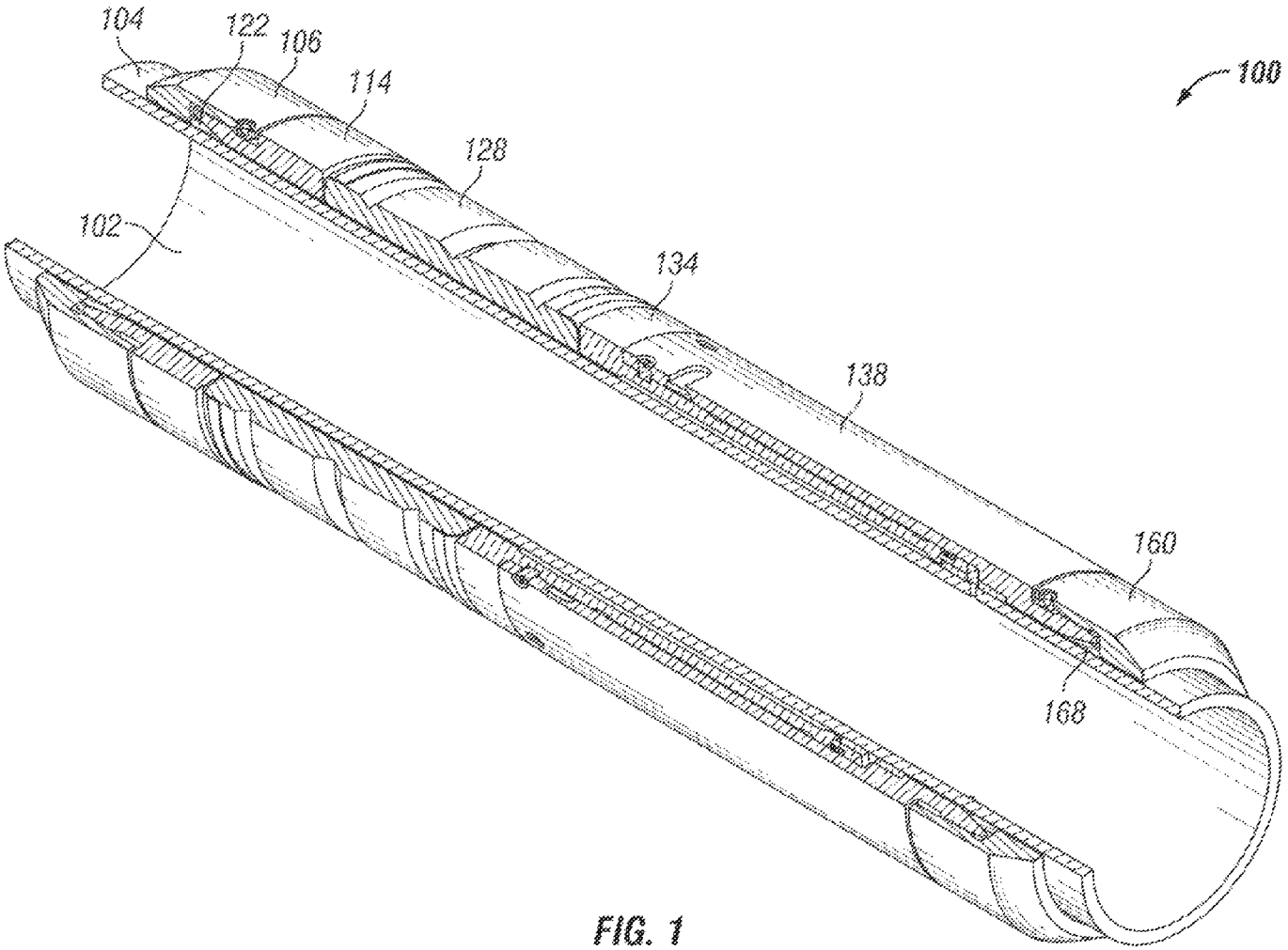
FIG. 1 illustrates a perspective view of an illustrative tool attached to a tubular (with an axial section removed), according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a perspective view of a section of a tool 100 attached to a tubular 102, according to an embodiment. In the embodiment shown, the tool 100 is a packer and is thus referred to herein as packer 100. However, it will be appreciated that the tool 100 may be any other type of tool that may be attached to a tubular, or string of tubulars, e.g., for use in a wellbore. The packer 100 may be configured to be disposed on and/or around an oilfield tubular 102, such as a casing, drill pipe, liner, one or more strings thereof, combinations thereof, and/or the like, e.g., between ends or joints thereof, so as to be spaced apart from the ends or joints, according to an embodiment. Accordingly, embodiments of the packer 100 may be located at any position along the tubular 102 between the ends thereof.

The packer 100 may include a first cap 106, which may be positioned around an outer surface 104 of the tubular 102. A first drive ring 114 may be positioned around the outer surface 104 of the tubular 102 and adjacent to the first cap 106. A first locking member 122 may be positioned at least partially around the outer surface 104 of the tubular 102. The first locking member 122 may be made from a material that is harder than the first cap 106 and/or the first drive ring 114. Further, the first locking member 122 may be positioned at least partially axially-between the first cap 106 and the first drive ring 114 and may extend axially beyond the first drive ring 114, such that the first locking member 122 may axially engage the first cap 106 in at least one configuration, as shown. The first locking member 122 may also be positioned radially-between the outer surface 104 of the tubular 102 and the first cap 106 and/or radially-between the outer surface 104 of the tubular 102 and the drive ring 114. When the first cap 106 is moved towards the drive ring 114 (or vice versa), the drive ring 114 may apply a radially-inward force on the first locking member 122, thereby securing the packer 100 on the tubular 102, as will be described in greater detail below.

A sealing element 128 may be positioned around the outer surface 104 of the tubular 102 and adjacent to the drive ring 114 and may be expandable in reaction to an axially-directed, compressive force applied thereto. A piston 134 may be positioned around the outer surface 104 of the tubular 102 and adjacent to the sealing element 128, for applying such compressive force. A sleeve 138 may be positioned around the outer surface 104 of the tubular 102 and adjacent to the piston 134. At least a portion of the sleeve 138 may be positioned radially-outward from the piston 134. A second cap 160 may be positioned around the outer surface 104 of the tubular 102 and adjacent to the sleeve 138.

A second locking member 168 may be positioned at least partially around the outer surface 104 of the tubular 102. The second locking member 168 may be positioned at least partially axially-between the sleeve 138 and the second cap 160. The second locking member 168 may also be positioned radially-between the outer surface 104 of the tubular 102 and the sleeve 138 and/or between the outer surface 104 of the tubular 102 and the second cap 160. These components are described in more detail below.

Figure 2:
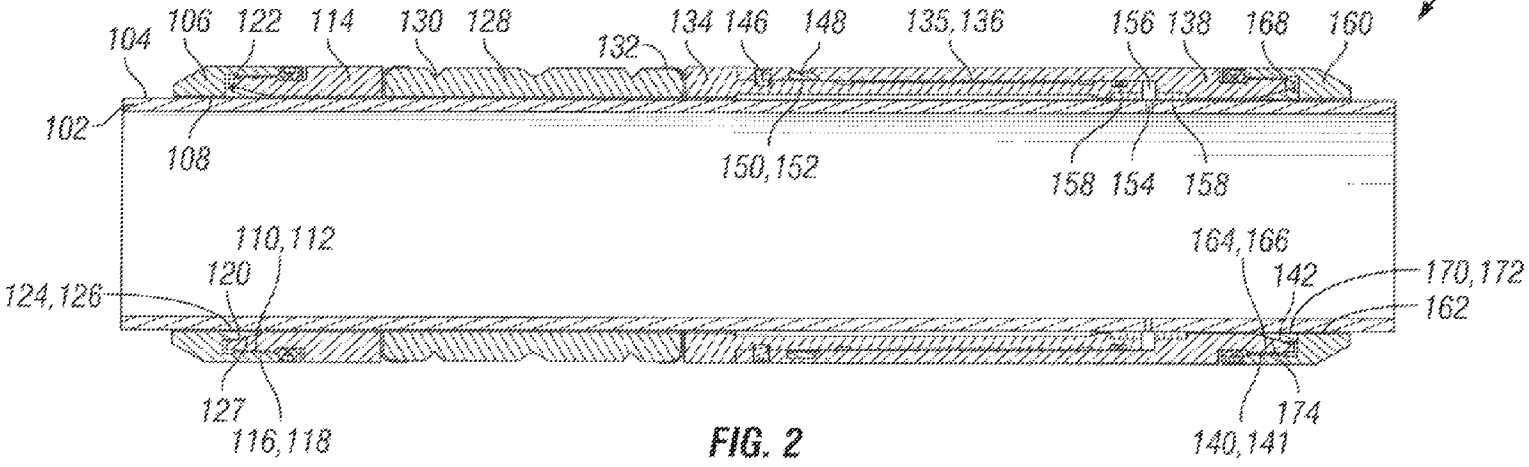
FIG. 2 illustrates a side cross-sectional view of the tool shown in FIG. 1 with a sealing element in a collapsed state, according to an embodiment.
Figure 3:
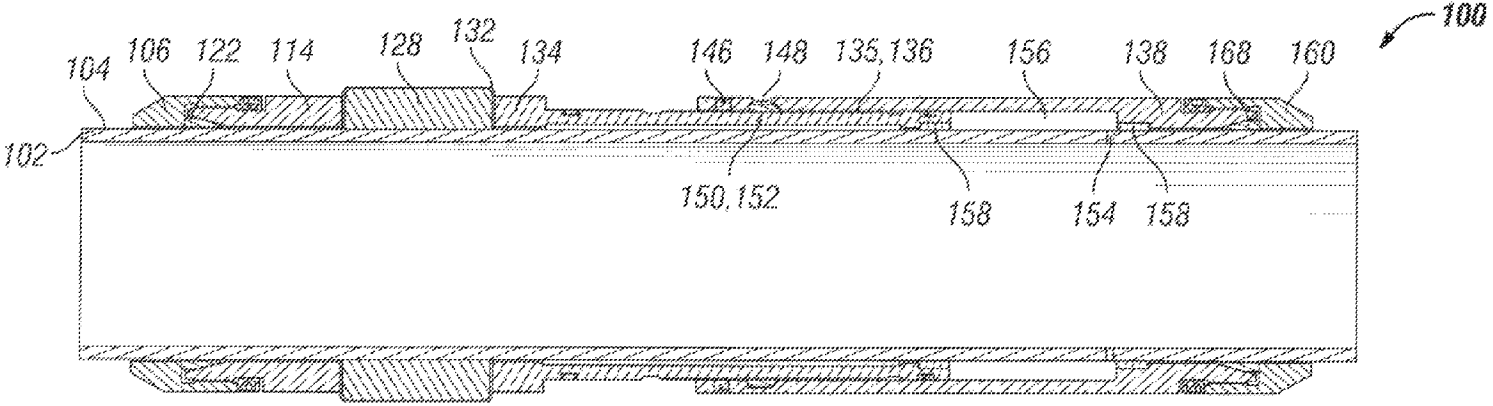
FIG. 3 illustrates a side cross-sectional view of the tool shown in FIGS. 1 and 2 with the sealing element in an expanded state, according to an embodiment.

FIG. 2 illustrates a side cross-sectional view of the packer 100 with the sealing element 128 in a collapsed state, and FIG. 3 illustrates a side cross-sectional view of the packer 100 with the sealing element 128 in an expanded state, according to an embodiment. Referring to FIGS. 2 and 3, the first cap 106 may have an inner surface that includes first and second portions 108, 110. The first portion 108 of the inner surface may be substantially smooth and in contact with the outer surface 104 of the tubular 102. The second portion 110 of the inner surface may be axially-offset from the first portion 108 of the inner surface. The second portion 110 of the inner surface may also be radially-offset (e.g., outward)

from the outer surface 104 of the tubular 102. In addition, the second portion 110 of the inner surface may have threads 112 formed thereon.

At least a portion of the drive ring 114 may be positioned radially-between the outer surface 104 of the tubular 102 and the second portion 110 of the inner surface of the first cap 106. This portion of the drive ring 114 may have threads 116 formed on the outer surface 118 thereof that are configured to engage the threads 112 of the first cap 106. This portion of the drive ring 114 may also include a sloped inner surface 120. More particularly, a distance between the inner surface 120 of the drive ring 114 and the outer surface 104 of the tubular 102 may decrease moving away from the first cap 106.

An inner surface 124 of the first locking member 122 may have a plurality of teeth 126 formed thereon that are configured to bite into or otherwise grip the outer surface 104 of the tubular 102. When the teeth 126 grip the outer surface 104 of the tubular 102, the first locking member 122 may be secured in place with respect to the tubular 102 (i.e., configured to withstand a predetermined axial and/or rotational force). In an embodiment, the teeth 126 may optionally include right-hand and left-hand threads, so as to prevent rotation of the first locking member 122 relative to the tubular 102. In an embodiment, at least some of the threads 112 may additionally or instead extend axially, so as to prevent rotation of the first locking member 122 relative to the tubular 102.

At least a portion of an outer surface 127 of the first locking member 122 may be sloped (e.g., at a non-zero angle with respect to the outer surface 104 of the tubular 102). For example, the outer surface 127 may be tapered opposite to the taper of the inner surface 120 of the drive ring 114, such that either may be referred to as "reverse-tapered" with respect to the other. In an embodiment, a distance between the sloped outer surface 127 of the first locking member 122 and the outer surface 104 of the tubular 102 may decrease moving away from the first cap 106. The outer surface 127 of the first locking member 122 may be sloped at substantially the same angle as the sloped inner surface 120 of the drive ring 114 such that the two surfaces 120, 127 may be parallel with and contact, e.g., slide against, one another.

The first locking member 122 may be in the form of an annular ring. The ring may be a continuous ring (e.g., 360°). In another embodiment, the ring may be a segmented or partially-segmented ring (e.g., including a plurality of circumferentially-offset or attached-together segments). In yet another embodiment, the ring may be a split ring (e.g., two segments each spanning 180° that are configured to connect to one another). In one particular example, the first locking member 122 may include a plurality of circumferentially-offset segments, each including a sloped outer surface 127, and the segments may be positioned within pockets that are defined by the tubular 102, the first cap 106, the drive ring 114, or a combination thereof.

The sealing element 128 may be made of rubber of any suitable hardness, or any other material designed to provide a seal with a surrounding tubular. In some embodiments, the surrounding tubular may be the wellbore wall, e.g., in open-hole applications. The sealing element 128 may include one or more notches 130 in the outer surface thereof. As shown, the notches 130 may be V-shaped. The sealing element 128 may be slid over the end of the tubular 102 and axially along the outer surface 104 of the tubular 102 into the desired position (e.g., abutting the drive ring 114). The sealing element 128 may be configured to be actuated from a first or "collapsed" state (as shown in FIGS. 1 and 2) to a second or "expanded" state (as shown in FIG. 3), as described in more detail below. In one embodiment, the sealing element 128 may include a portion that is swellable upon contact with a predetermined fluid.

One or more gage rings 132 may be positioned around at least a portion of the sealing element 128. The gage rings 132 may mate with the sealing element 128 and provide structural stability once the sealing element 128 is actuated. In at least one embodiment, a seal backup system may be integral with the gage rings 132 to prevent swab-off. For example, the gage rings 132 may prevent the sealing element 128 from being pulled off the tubular 102 due to fluid flow, or otherwise prevent fluid from flowing radially between the tubular 102 and the sealing element 128.

An outer surface 135 of the piston 134 may include a plurality of teeth 136. The teeth 136 may be axially-offset and/or circumferentially-offset from one another. The piston 134 may be coupled to the sleeve 138 with one or more shear mechanisms (e.g., shear pins or screws) 146. For example, the piston 134 may be coupled to the sleeve 138 with a plurality of shear mechanisms 146 that are circumferentially-offset from one another. The shear mechanisms 146 may be configured to break when exposed to a predetermined axial and/or rotational force.

A ratchet ring 148 may be positioned within a pocket or recess in the sleeve 138. In another embodiment, the ratchet ring 148 may be positioned radially-between the piston 134 and the sleeve 138. In yet another embodiment, the ratchet ring 148 may be coupled to or integral with the sleeve 138. The ratchet ring 148 may be in contact with the outer surface 135 of the piston 134. The inner surface 150 of the ratchet ring 148 may include a plurality of teeth 152 configured to engage the teeth 136 on the outer surface 135 of the piston 134. The teeth 136, 152 may be configured to allow the piston 134 to move in one axial direction with respect to the ratchet ring 148 (e.g., to the left, as shown in FIG. 2), and to lock and prevent movement in a second, opposing axial direction (e.g., to the right, as shown in FIG. 2).

One or more openings 154 formed radially-through the tubular 102 may place the interior of the tubular 102 in fluid communication with one or more chambers 156. As will be described herein, the location of the packer 100 may be decided, and then the openings 154 may be formed in the tubular 102 based on the desired location of the packer 100. In at least one embodiment, one or more nozzles, orifices, valves and/or rupture or burst disks, dissolvable plugs, etc. may be positioned within the openings 154. As shown, the chamber 156 may be defined by the tubular 102, the piston 134, and the sleeve 138. One or more seals 158 may be positioned proximate to the chambers 156 to prevent fluid leakage. As shown, a first seal 158 may be positioned on a first axial side of the chambers 156 and radially-between the outer surface 104 of the tubular 102 and the piston 134. A second seal 158 may be positioned on a second axial side of the chambers 156 and radially-between the outer surface 104 of the tubular 102 and the sleeve 138.

The sleeve 138 may optionally provide a second drive ring. In some embodiments, however, the second drive ring may be provided as a separate piece, which may be coupled with or otherwise disposed axially-adjacent to the sleeve 138. In still other embodiments, a second drive ring may be omitted. In the illustrated example, with the sleeve 138 providing the second drive ring, the sleeve 138 may have threads 140 formed on an outer surface 141 thereof. The sleeve 138 may also include a sloped inner surface 142. More particularly, a distance between the inner surface 142 of the sleeve 138 and the outer surface of the tubular 102 may increase moving toward the second cap 160.

The second cap 160 may have an inner surface that includes first and second portions 162, 164. The first portion 162 of the inner surface may be substantially smooth and in contact with the outer surface 104 of the tubular 102. The second portion 164 of the inner surface may be axially-offset from the first portion 162 of the inner surface. The second portion 164 of the inner surface may also be radially-offset (e.g., outward) from the outer surface 104 of the tubular 102. In addition, the second portion 164 of the inner surface may have threads 166 formed thereon that are configured to engage the threads 140 of the sleeve 138.

The second locking member 168 may be substantially similar to the first locking member 122. For example, an inner surface 170 of the second locking member 168 may have a plurality of teeth 172 formed thereon that are configured to grip the outer surface 104 of the tubular 102. When the teeth 172 grip the outer surface 104 of the tubular 102, the second locking member 168 may be secured in place with respect to the tubular 102 (i.e., configured to withstand a predetermined axial and/or rotational force). In at least one embodiment, the teeth 172 may be or include helical threads configured to threadably engage corresponding threads on the outer surface 104 of the tubular 102. In one embodiment, an adhesive, such as a glue or epoxy, may be placed on the outer surface 104 of the tubular 102 (or the teeth 172) prior to the teeth 172 gripping the tubular 102. The adhesive may be configured to actuate when the teeth 172 grip the outer surface 104 of the tubular 102.

At least a portion of the outer surface 174 of the second locking member 168 may be sloped. More particularly, a distance between the sloped outer surface 174 of the second locking member 168 and the outer surface 104 of the tubular 102 may increase moving toward the second cap 160. The outer surface 174 of the second locking member 168 may be sloped at substantially the same angle as the sloped inner surface 142 of the sleeve 138 such that the two surfaces 142, 174 may be parallel with and contact one another, as discussed in greater detail below.

Figure 4:
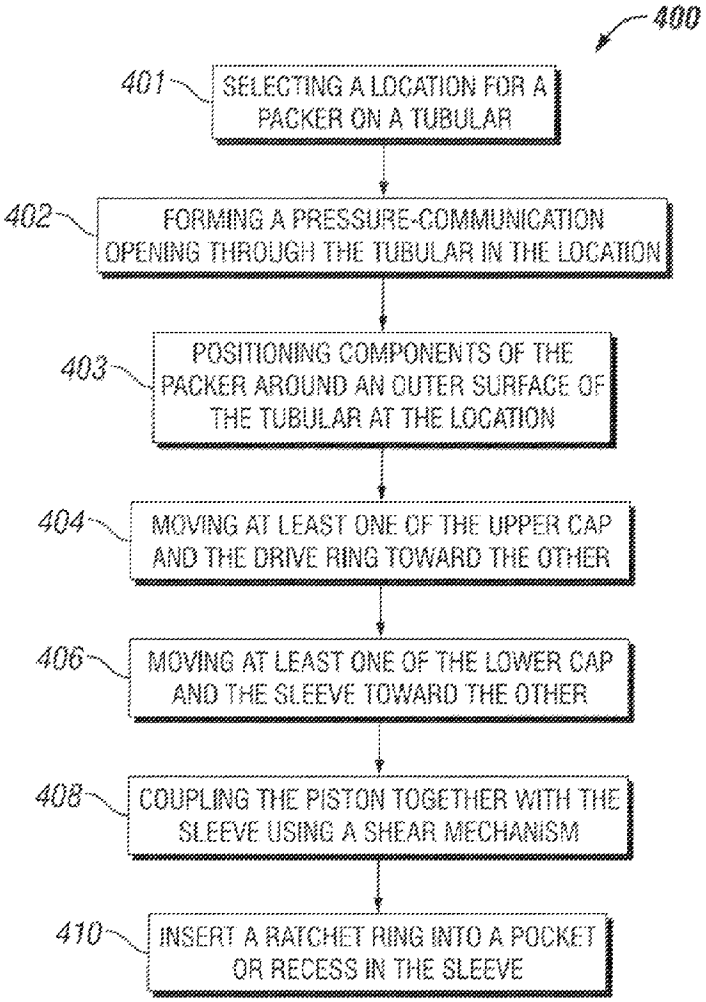
FIG. 4 illustrates a flowchart of a method for assembling the tool, according to an embodiment.

FIG. 4 illustrates a flowchart of a method 400 for assembling the packer 100, according to an embodiment. Although the method 400 is described with reference to the packer 100, it will be appreciated that one or more embodiments are not limited to any particular structure.

In an embodiment, the method 400 may include selecting a location for the packer 100 on the tubular 102, e.g., where the packer 100 may be connected, as at 401. The location may be between ends of the tubular 102, e.g., anywhere along the length of the tubular 102. The method 400 may then include drilling or otherwise forming one or more pressure-communication openings 154 through the wall of the tubular 102, such that the inside of the tubular 102 communicates with the outside thereof via the pressure-communication openings 154, as at 402. In some embodiments, such pressure communication may be selective or otherwise controlled, e.g., by placement of a flow-control device, such as a rupture or burst disk, valve, dissolvable plug, orifice, etc. in or on the pressure-communication openings 154. In some embodiments, the pressure communication may be unregulated or continuous, e.g., by with such flow-control devices being omitted.

The method 400 may then include positioning components of the packer 100 around the outer surface 104 of the tubular 102 at the selected location, as at 403. More particularly, the components may be positioned around the outer surface 104 of the tubular 102 such that the openings 154 are in fluid communication with the chamber 156. In at least one embodiment, the components may be slid over an end of the tubular 102 and axially-along the outer surface 104 of the tubular 102 to the desired location. In another embodiment, the components may be hinged such that the components are moved laterally into place and closed around the tubular 102. The components may include the first cap 106, the drive ring 114, the first locking member 122, the sealing element 128, the piston 134, the sleeve 138, the second cap 160, and/or the second locking member 168. In an embodiment, the sleeve 138 and the piston 134 may at least partially define a chamber 156 therebetween, which may be aligned with the pressure-communication openings 154, so as to be in (e.g., selective or continual) pressure communication with the interior of the tubular 102. In one embodiment, the tubular 102 may include a seat (not shown) that is configured to receive an impediment member that closes the flow through the bore of the tubular 102 and directs the flow through the openings 154.

At least one of the first cap 106 and the drive ring 114 may be moved toward the other, as at 404. In at least one embodiment, the first cap 106 and the drive ring 114 may be moved toward one another via relative rotation between the first cap 106 and the drive ring 114. In other embodiments, hydraulics and/or mechanical assemblies may be employed to adduct the first cap 106 and the drive ring 114 together linearly, with or without rotation. In the rotational adduction embodiments, the rotation may cause the first cap 106 and the drive ring 114 to be pulled toward one another due to the engagement between the threads 112 of the first cap 106 and the threads 118 of the drive ring 114. As the drive ring 114 moves toward the first cap 106, the sloped inner surface 120 of the drive ring 114 may exert a radially-inward force on the sloped outer surface 127 of the first locking member 122. Additional rotations may increase this force. This may cause the first locking member 122 to apply a radially-inward gripping force on the outer surface 104 of the tubular 102. More particularly, this may cause the teeth 126 on the inner surface 124 of the first locking member 122 to "bite" into the outer surface 104 of the tubular 102 such that the first locking member 122 (and the first cap 106 and drive ring 114) are secured in place and configured to withstand a predetermined axial and/or rotational force.

Similarly, at least one of the second cap 160 and the sleeve 138 may be moved toward the other, e.g., in the same manner as described above, as at 406. For example, the second cap 160 and the sleeve 138 may be rotated with respect to one another, and the rotation may cause the sleeve 138 and the second cap 160 to be pulled toward one another due to the engagement between the threads 140 of the sleeve 138 and the threads 166 of the second cap 160. As the second cap 160 moves toward the sleeve 138, the sloped inner surface 142 of the sleeve 138 may exert a radially-inward force on the sloped outer surface 174 of the second locking member 168. Additional rotations may increase this force. This may cause the second locking member 168 to apply a radially-inward gripping force on the outer surface 104 of the tubular 102. More particularly, this may cause the teeth 172 on the inner surface 170 of the second locking member 168 to "bite" into the outer surface 104 of the tubular 102 such that the second locking member 168 (and the sleeve 138 and the second cap 160) are secured in place and configured to withstand a predetermined axial and/or rotational force.

The one or more shear mechanisms 146 may be coupled (e.g., threaded) to the piston 134 and the sleeve 138, as at 408. The ratchet ring 148 may be inserted into a pocket or recess in the sleeve 138 such that the teeth 152 on the inner surface 150 of the ratchet ring 148 are in contact with the outer surface of the sleeve 138, as at 410.

Figure 5:
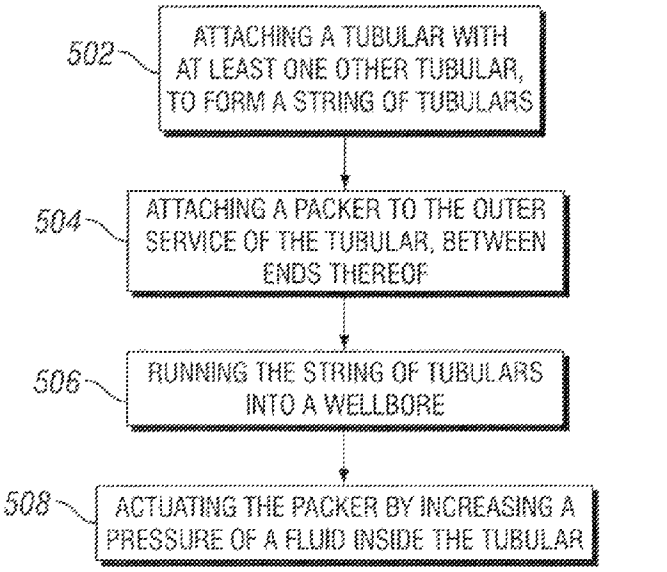
FIG. 5 illustrates a flowchart of a method for running the tool into a wellbore and actuating the tool, according to an embodiment.

FIG. 5 illustrates a flowchart of a method 500 for running the packer 100 into a wellbore and actuating the packer 100, according to an embodiment. Although the method 500 is described with reference to the packer 100, it will be appreciated that one or more embodiments of the method 500 are not limited to any particular structure. The method 500 may include connecting together (e.g., "making up") the tubular 104 to at least one other tubular, thereby forming or adding to a string of tubulars, as at 502. The method 500 may also include attaching the packer 100 to the outer surface 104 of the tubular 102 anywhere along the tubular 102, e.g., between the ends thereof, as at 504. Attaching the packer 100 at 504 may proceed according to one or more embodiments of the method 400 described above.

The string, including the packer 100, may then be run into a wellbore with the sealing element 128 in the collapsed state (FIGS. 1 and 2), as at 506. Once the packer 100 reaches the desired depth in the wellbore, the sealing element 128 may be actuated into the expanded state, as at 508. To actuate the sealing element 128, the pressure of the fluid inside the tubular 102 may be increased (e.g., by a pump at the surface and/or by closing a valve distal to the packer 100). This pressurized fluid may flow through the openings 154 in the tubular 102 and into the chambers 156. As the pressure of the fluid in the chambers 156 increases, this fluid may exert a force on the piston 134. More particularly, the fluid may exert an axial force on the piston 134 in the direction of the sealing element 128. When the force reaches a predetermined amount, the shear mechanisms 146 may break, thereby allowing the piston 134 to move with respect to the tubular 102. The piston 134 may move toward the sealing element 128 (e.g., to the left, as shown in FIG. 2), causing the sealing element 128 to be axially-compressed between the piston 128 and the stationary drive ring 114. This compression may cause the sealing element 128 to expand radially-outward, as shown in FIG. 3. More particularly, the sealing element 128 may expand into contact with an outer tubular and seal an annulus formed between the tubular 102 and the outer tubular. The outer tubular may be a liner, a casing, a wall of the wellbore, or the like.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A downhole packer comprising:

a first locking member positioned at least partially around an outer surface of an oilfield tubular, the first locking member comprising an inner surface that engages the outer surface of the tubular, and a tapered outer surface;

a drive ring positioned at least partially around the first locking member and comprising a reverse-tapered inner surface that engages the tapered outer surface of the first locking member;

a first cap movably coupled with the drive ring, disposed at least partially around the first locking member, and axially-engaging the first locking member, wherein moving at least one of the first cap and the drive ring toward the other causes the drive ring to apply a radially-inward force on the first locking member, causing the first locking member to be secured to the tubular; and a sealing element configured to be disposed at least partially around the tubular and held in position at least axially with respect thereto by the first locking member engaging the tubular, wherein the sealing element is configured to expand radially-outward in response to application of an axially-directed, compressive force, wherein the inner surface of the first locking member comprises a plurality of teeth, and wherein relative rotation between the drive ring and the first cap causes the first cap and the drive ring to move closer together.

2. The downhole packer of claim 1, wherein the drive ring is disposed axially-intermediate of the sealing element and the first cap.

3. The downhole packer of claim 1, wherein:

an inner surface of the first cap has a plurality of threads formed thereon that engage a plurality of threads formed on an outer surface of the drive ring;

the first locking member is positioned at least partially axially-between the first cap and the drive ring; and the first locking member is positioned at least partially radially-between the outer surface of the tubular and the drive ring, at least partially radially-between the outer surface of the tubular and the first cap, or both.

4. A downhole packer comprising:

a first locking member positioned at least partially around an outer surface of an oilfield tubular, the first locking member comprising an inner surface that engages the outer surface of the tubular, and a tapered outer surface;

a drive ring positioned at least partially around the first locking member and comprising a reverse-tapered inner surface that engages the tapered outer surface of the first locking member;

a first cap movably coupled with the drive ring, disposed at least partially around the first locking member, and axially-engaging the first locking member, wherein moving at least one of the first cap and the drive ring toward the other causes the drive ring to apply a radially-inward force on the first locking member, causing the first locking member to be secured to the tubular; and a sealing element configured to be disposed at least partially around the tubular and held in position at least axially with respect thereto by the first locking member engaging the tubular, wherein the sealing element is configured to expand radially-outward in response to application of an axially-directed, compressive force, wherein the inner surface of the first locking member comprises a plurality of teeth, and wherein the plurality of teeth comprise at least two of: left-hand threads, right-hand threads, and axially-extending threads.

5. The downhole packer of claim 4, further comprising:

a piston positioned at least partially around the outer surface of the tubular and adjacent to the sealing element, wherein the piston is movable in at least one axial direction, to apply the compressive force to the sealing element; and a sleeve positioned a least partially around an outer surface of the piston, wherein a chamber is defined between the outer surface of the tubular and the piston, between the outer surface of the tubular and the sleeve, or a combination thereof, and wherein the chamber is in fluid communication with an interior of the tubular through an opening in the tubular.

6. The downhole packer of claim 5, further comprising a ratchet ring positioned at least partially around the outer surface of the piston, wherein an inner surface of the ratchet ring has a plurality of teeth formed thereon that are configured to engage a corresponding plurality of teeth formed on the outer surface of the piston, thereby allowing the piston to move in a first axial direction with respect to the tubular while preventing the piston from moving in a second, opposing axial direction with respect to the tubular.

7. The downhole packer of claim 6, wherein the ratchet ring is positioned within a recess or pocket formed in the sleeve.

8. The downhole packer of claim 5, further comprising a second locking member positioned at least partially around the outer surface of the tubular, wherein an inner surface of the second locking member has a plurality of teeth formed thereon that contact the outer surface of the tubular, and wherein an outer surface of the second locking member is sloped at a non-zero angle with respect to the outer surface of the tubular.

9. The downhole packer of claim 8, wherein an inner surface of the sleeve is sloped at a non-zero angle with respect to the outer surface of the tubular, and wherein the inner surface of the sleeve is configured to contact the outer surface of the second locking member.

10. The downhole packer of claim 8, further comprising a second cap positioned at least partially around the outer surface of the tubular, wherein an inner surface of the second cap has a plurality of threads formed thereon that are configured to engage a plurality of threads formed on an outer surface of the sleeve, wherein the second locking member is positioned at least partially axially-between the sleeve and the second cap, and wherein the second locking member is positioned at least partially radially-between the outer surface of the tubular and the sleeve, at least partially radially-between the outer surface of the tubular and the second cap, or both.

11. The downhole packer of claim 10, wherein relative rotation between the sleeve and the second cap causes the second locking member to apply a radially-inward gripping force against the outer surface of the tubular.

12. A method for assembling a downhole packer, comprising:

positioning a first cap, a first locking member, a drive ring, and a sealing element around an outer surface of a tubular, wherein the first locking member is positioned at least partially axially-between the first cap and the drive ring, and wherein the first locking member is positioned at least partially radially-between the outer surface of the tubular and the drive ring, at least partially radially-between the outer surface of the tubular and the first cap, or both; and moving the first cap and the drive ring toward one another, thereby causing the first locking member to apply a radially-inward force against the outer surface of the tubular to secure the packer in place on the tubular, wherein an inner surface of the first cap has a plurality of threads formed thereon that are configured to engage a corresponding plurality of threads on an outer surface of the drive ring, and wherein moving the first cap and the drive ring toward one another comprises rotating the first cap with respect to the drive ring.

13. A method for assembling a downhole packer, comprising:

positioning a first cap, a first locking member, a drive ring, and a sealing element around an outer surface of a tubular, wherein the first locking member is positioned at least partially axially-between the first cap and the drive ring, and wherein the first locking member is positioned at least partially radially-between the outer surface of the tubular and the drive ring, at least partially radially-between the outer surface of the tubular and the first cap, or both;

moving the first cap and the drive ring toward one another, thereby causing the first locking member to apply a radially-inward force against the outer surface of the tubular to secure the packer in place on the tubular; and positioning a piston, a sleeve, a second locking member, and a second cap around the outer surface of the tubular, wherein the piston is positioned adjacent to the sealing element, wherein at least a portion of the sleeve is positioned radially-outward from the piston, wherein an inner surface of the second cap has a plurality of threads formed therein that are configured to engage a corresponding plurality of threads on an outer surface of the sleeve, and wherein an inner surface of the sleeve and an outer surface of the second locking member are sloped at non-zero angles with respect to the outer surface of the tubular and configured to contact one another.

14. The method of claim 13, further comprising inserting a ratchet ring into a pocket or recess formed in the sleeve, wherein an inner surface of the ratchet ring has a plurality of teeth formed thereon that are configured to engage a corresponding plurality of teeth formed on an outer surface of the piston, thereby allowing the piston to move in a first axial direction with respect to the tubular while preventing the piston from moving in a second, opposing axial direction with respect to the tubular.

15. The method of claim 13, further comprising:

selecting a location for the packer on the tubular between ends of the tubular;

forming one or more pressure-communication openings through the tubular at the location; and aligning a chamber with the one or more pressure-communication openings, wherein the chamber is defined radially between the sleeve and the tubular and at least partially defined by the piston.

16. A method for actuating a packer in a wellbore, comprising:

running the packer into the wellbore, wherein the packer comprises:

a first locking member positioned at least partially around an outer surface of a tubular, wherein an inner surface of the first locking member has a plurality of teeth formed thereon that contact the outer surface of the tubular, and wherein an outer surface of the first locking member is sloped at a non-zero angle with respect to the outer surface of the tubular;

a drive ring positioned at least partially around the outer surface of the tubular, wherein an inner surface of the drive ring is sloped at a non-zero angle with respect to the outer surface of the tubular, and wherein the inner surface of the drive ring is configured to contact the outer surface of the first locking member;

a first cap positioned at least partially around the outer surface of the tubular, wherein an inner surface of the first cap has a plurality of threads formed thereon that are configured to engage a plurality of threads formed on an outer surface of the drive ring;

a sealing element positioned at least partially around the outer surface of the tubular and adjacent to the drive ring;

a piston positioned at least partially around the outer surface of the tubular and adjacent to the sealing element; and a sleeve positioned a least partially around an outer surface of the piston, wherein a chamber is defined between the outer surface of the tubular and the piston, between the outer surface of the tubular and the sleeve, or a combination thereof, and wherein the chamber is in fluid communication with an interior of the tubular through an opening in the tubular; and causing a pressure of a fluid in the tubular and in the chamber to increase, wherein, in response to the increased pressure, the piston moves axially toward the sealing element, causing the sealing element to actuate radially-outward from a collapsed state to an expanded state.

17. The method of claim 16, wherein the first locking member is positioned at least partially axially-between the first cap and the drive ring, and wherein the first locking member is positioned at least partially radially-between the outer surface of the tubular and the drive ring, at least partially radially-between the outer surface of the tubular and the first cap, or both.

* * * * *